United States Patent [19]

Eheim et al.

[11] Patent Number: 4,461,255

[45] Date of Patent: Jul. 24, 1984

[54] RPM GOVERNOR FOR A FUEL INJECTION PUMP

[75] Inventors: Franz Eheim, Stuttgart; Gerald Höfer, Weissach-Flacht, both of Fed. Rep. of Germany

[73] Assignee: Robert Bosch GmbH, Stuttgart, Fed. Rep. of Germany

[21] Appl. No.: 438,441

[22] Filed: Nov. 2, 1982

Related U.S. Application Data

[62] Division of Ser. No. 334,715, Dec. 28, 1981, Pat. No. 4,393,835, which is a division of Ser. No. 81,285, Oct. 2, 1979, Pat. No. 4,325,337.

[30] Foreign Application Priority Data

Oct. 17, 1978 [DE] Fed. Rep. of Germany ..... 2845096

[51] Int. Cl.[3] ..... F02D 31/00

[52] U.S. Cl. ..... 123/357

[58] Field of Search ..... 123/357, 350, 365, 449

[56] References Cited

U.S. PATENT DOCUMENTS

| | | | |
|---|---|---|---|
| 3,661,130 | 5/1972 | Eheim | 123/357 |
| 3,841,286 | 10/1974 | Eheim | 123/357 |
| 4,036,193 | 7/1977 | Kobayashi et al. | 123/357 |
| 4,220,128 | 9/1980 | Kobayashi | 123/449 |

FOREIGN PATENT DOCUMENTS

| | | | |
|---|---|---|---|
| 2403081 | 7/1975 | Fed. Rep. of Germany | 123/449 |
| 2503346 | 7/1976 | Fed. Rep. of Germany | 123/449 |

OTHER PUBLICATIONS

Straubel & Laufer, Distributor Injection Pump, "The ASME Publication", Jun. 29, 1978.

*Primary Examiner*—Magdalen Y. C. Moy

*Attorney, Agent, or Firm*—Edwin E. Greigg

[57] ABSTRACT

An rpm governor is proposed, in which intervention into the regulation process can be made directly via a magnet, so that the degree of proportionality, particularly with isostatic governors, can be lowered to a minimum.

1 Claim, 8 Drawing Figures

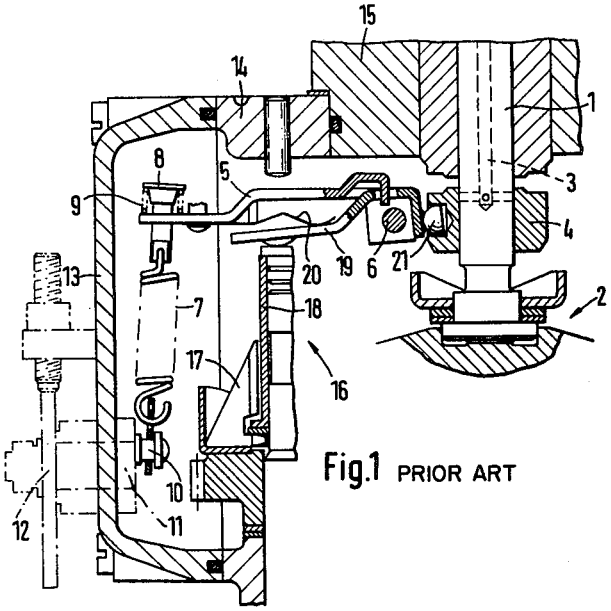
Fig.1 PRIOR ART
Fig.2
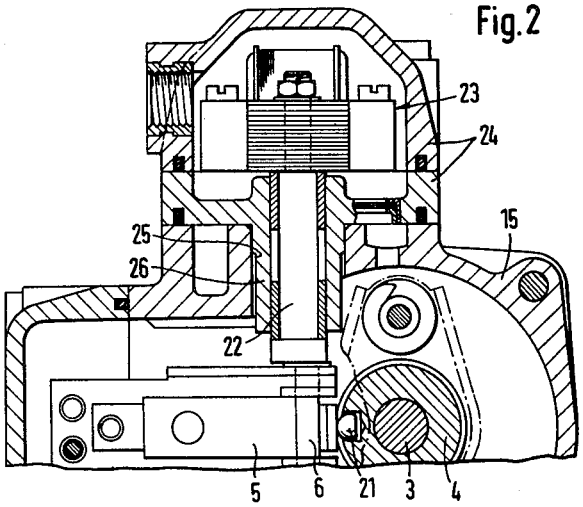

RPM GOVERNOR FOR A FUEL INJECTION PUMP

This is a division of application Ser. No. 334,715, filed Dec. 28, 1981, now U.S. Pat. No. 4,393,835, which is a division of 081,285 filed Oct. 2, 1979, now U.S. Pat. No. 4,325,337.

BACKGROUND OF THE INVENTION

The invention relates to an rpm governor for a fuel injection pump of an internal combustion engine. In a known rpm governor of this type, adjustment takes place by means of an adjusting piston exposed to fuel, with the fuel flow controlled by magnetic valves. This known device is relatively expensive and, because of the elasticity of the hydraulics and the indirect electrical control through the use of hydraulics as an intermediary, it is relatively sluggish and imprecise. This is particularly true when the governor is intended to operate as an isostatic governor, with a degree of proportionality between 0 and 5%.

OBJECT AND SUMMARY OF THE INVENTION

Therefore, it is a primary object of the invention to provide a fuel injection pump in which the external disturbances of the regulation process which arise during operation can be rapidly eliminated at a very low degree of proportionality, so that a desired regulation value at the output of the regulation corresponds to the guide value supplied to the regulation. A whole series of various possibilities are offered for intervention in the regulation process, which have decisive advantages for various particular applications.

The invention will be better understood, and further objects and advantages thereof will become more apparent from the ensuing detailed description of preferred embodiments taken in conjunction with the drawings.

BRIEF DESCRIPTION OF THE DRAWINGS

FIG. 1 is a fragmentary cross-sectional view of a known type of governor;

FIG. 2 is a fragmentary first embodiment of this invention looking downwardly of FIG. 1 at the pump piston and further showing an electromagnet in elevation which cooperates with said piston;

DESCRIPTION OF THE PREFERRED EMBODIMENTS

Figure 3:
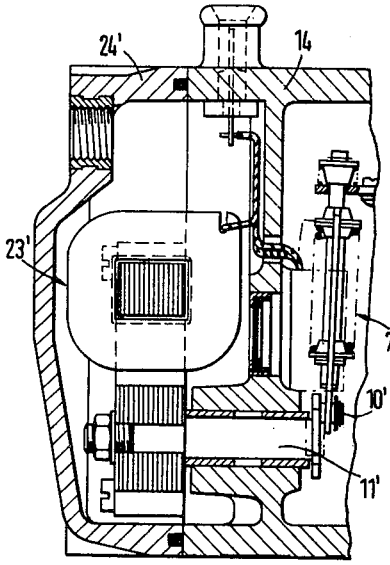
FIG. 3 is a second embodiment of this invention which reveals a rotary magnet in driving relation with the governor spring.

In FIG. 1, the elements of a fuel injection pump with an rpm governor which are essential for the description of the invention are shown. A pump piston 1 is set into a simultaneously reciprocating and rotating motion by a cam drive 2. A bore 3 opening into a pump work chamber (not shown) is controlled by a valve spool 4, which is axially displaceable by the governor, for the purpose of determining the injection quantity. Fuel is injected during the pressure stroke of the pump piston 1, so long as the bore 3 is blocked by the valve spool 4; the injection is terminated when the bore 3 emerges from the valve spool 4, through the substantially pressure-free escape of the fuel from the pump work chamber via the bore 3.

The rpm governor has a governor lever 5 which is supported on a shaft 6 and engaged by a governor spring 7. The governor spring 7 is suspended at one end from a bolt 8; and another supplemental governor spring 9 is disposed between the bolt 8 and the governor lever 5. The other end of the governor spring 7 is attached to a tank 10 which is fixed eccentrically on a shaft 11, which is rotatable in the housing 13 of the governor via an adjustment lever 12. This housing 13 is attached to an intermediate housing 14, which intermediate housing in turn is secured to the housing 15 of the injection pump. The pump piston 1 drives an rpm adjuster 16 in which an adjustment sleeve 18 is displaced by means of flyweights 17 all of which is known from the prior art. The adjustment sleeve 18 engages a starting lever 19. After the internal combustion engine is started, as soon as the starting lever 19 is pushed by the rpm adjuster 16 toward a starting spring 20, this lever 19 strikes against the governor lever 5, so that there is a force connection in the manner of a drag member between these two levers. The valve spool 4 is coupled to the governor via a ball-like element 21 which is secured to the starting lever 19. Thus, it is believed that the basic function of this governor is generally familiar.

In the first exemplary embodiment shown in FIG. 2, the shaft 6 is secured eccentrically on a shaft 22 of an electromagnet 23; the electromagnet 23 is embodied as a rotary magnet, so that rotation of the shaft 22 causes a displacement in position of the shaft 6. As a result, a direct intervention into the regulation process is made, because as a result of the displacement, the spool valve 4 is also displaced; that is, the relationship between the forces of the governor spring 7 and the rpm adjuster 16 undergo variation. In this manner, correction of disturbances can take place very rapidly, so that the actual value can again be adapted to the desired value with a minimum degree of proportionality. One example of a rotary magnet is described in more detail in FIG. 5. It is also important that an intervention of this kind can take place without critical alteration of the structure of the injection pump and the governor. In this example, only a magnet housing 24 is secured onto the pump housing 15 at the appropriate location. The opening or bore 25, into which the sleeve section 26 of the housing 24 is inserted, normally serves to receive a mounting for the shaft 22 and the shaft 6, which likewise permits a displacement of the shaft through rotation, that is, when the shaft is adjusted. The housing 24 also has fuel flowing through it from the housing 15, so that the electromagnet 23 is cooled at the same time. As in all the examples, naturally a solenoid can be used instead of a rotary magnet, with an appropriate deviation of forces.

In the second exemplary embodiment shown in FIG. 3, the shaft 11′ is rotated by the rotary magnet 23′, on which the tank 10′ is secured, on which in turn the governor spring 7′ is hung. The governor spring 7′ is shown here as an encapsulated compression spring; however, its function is the same as that of the spring 7 in the first exemplary embodiment. In this exemplary embodiment, the guide value for the regulation is supplied by the magnet 23′, whose housing 24′ is correspondingly secured on the pump housing 14. As in the previous example, the housing 24′ here too has fuel flowing through it from the housing 15.

Figure 4:
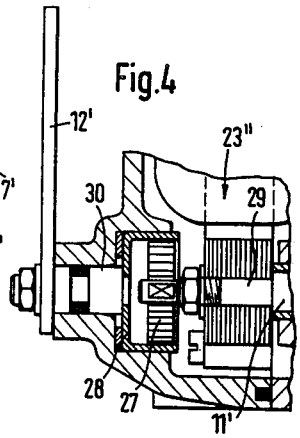
FIG. 4 is a further fragmentary exemplification of a rotary magnet cooperating with an elastic coupling which in turn is in driving relation with the governor spring.

In FIG. 4, the third exemplary embodiment is shown, in which the magnet 23″ has only a secondary role in the adjustment of the shaft 11′. Here, an elastic coupling which functions with a spiral spring 27 is disposed between the arbitrarily actuatable adjustment lever 12′ and the shaft 11′. The spiral spring 27 is secured at its outer end in a cup 28, while the inner end is disposed on the end of the shaft 29 which is connected to the shaft 11′ and on which the armature of the magnet 23′ is secured. A shaft stub 30 is coaxially secured to the cup 28 and is engaged by the adjustment shaft 12′. As a result, it is possible for the guide value to be supplied via the adjustment lever 12′; however, the guide value can be influenced by the rotary magnet 23″ in such a way that a correction of the governor value or adjustment value takes place at the valve spool 4. (See FIGS. 1 and 2.)

Figure 5:
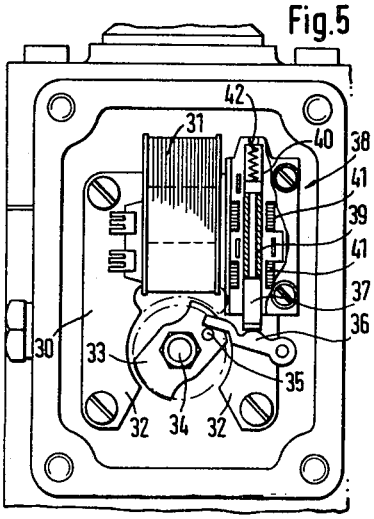
FIG. 5 is a horizontal elevational view of another embodiment of this invention showing an end plate of the housing removed so as to look into a magnetic coil which is arranged to drive a transducer.

In FIG. 5, a rotary magnet is shown in plan view. In the base of a U-shaped core 30, a magnetic coil 31 is arranged. Between the yokes 32-32 disposed at the end of the arms of the core 30, an armature 33 is supported on a shaft 34. A tank 35, which is provided on the armature 33, acts upon a lever 36 upon rotary movement of the armature 33. The lever 36 actuates the armature 37 of a transducer 38. On the armature 37, the transducer 38 has a ferrite core 39, opposite which induction coils 41 are disposed in the transducer housing 40. The armature 37 of the transducer is stressed by a spring 42.

In order to be able to process the individual actual values in the electronic control device (not shown), transducers are provided, in a manner similar to that described with a rotary magnet, when other means as well are used for attaining the desired regulation. The basic principle is that an rpm transducer is always provided, which measures the rpm either directly at the motor or at the drive shaft of the injection pump.

Figure 6:
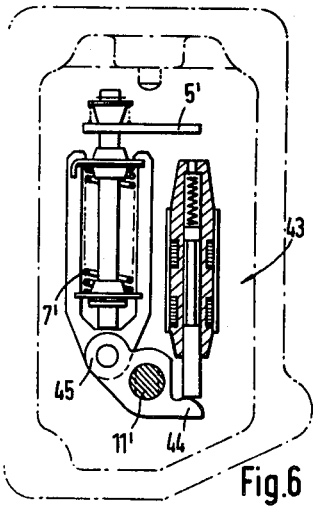
FIG. 6 is another horizontal elevational view of an embodiment of a transducer that may be used with the embodiments of this invention shown in FIGS. 3 and 4.

In FIG. 6, a different arrangement is shown with a lifting transducer, which can be used in the second and third embodiments instead of the transducer shown in FIG. 5. In principle, the transducer 43 is embodied like the transducer 38 of FIG. 5; however, it is actuated by a lever arm 44, which is connected to the shaft 11′. The lever 44 is embodied here as part of a double lever on the other arm 45 on which the governor spring 7′ is suspended.

Figure 7:
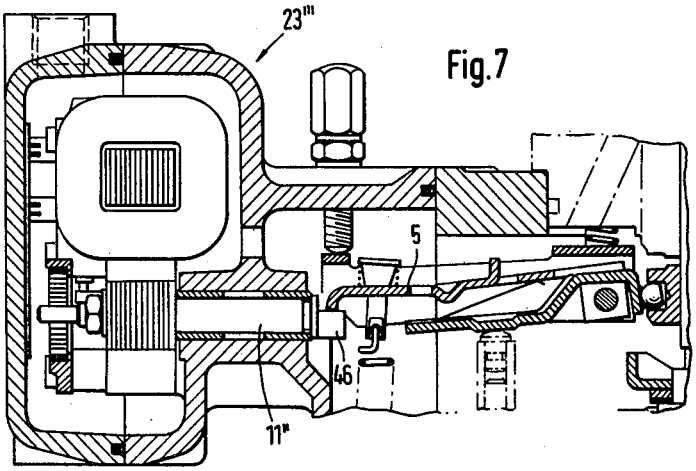
FIG. 7 is a fragmentary view of another embodiment of this invention in which a rotary magnet is arranged to engage the governor starting lever.

In the fourth exemplary embodiment shown in FIG. 7, a tang 46 eccentrically disposed on the shaft 11″ of a rotary magnet 23‴ engages the governor lever 5. As a result, the full-load injection quantity is variable during operation, which can take place particularly in accordance with the temperature, which can be critically distrubing to the regulation process.

Figure 8:
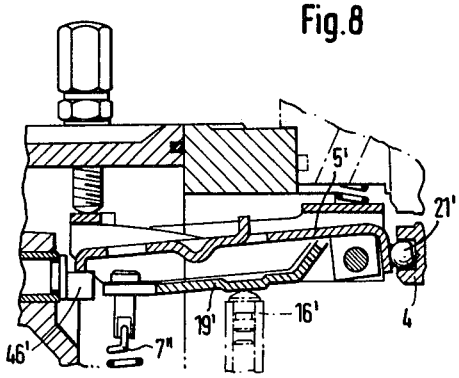
FIG. 8 is a modified fragmentary view of the embodiment of the structure shown in FIG. 7 in which the rotary magnet is arranged to engage the governor lever.

In contrast to this, in the exemplary embodiment shown in FIG. 8, the spool valve 4 of the injection pump is controlled directly by the tang 46′, since the coupler or ball like element 21′ is secured directly to the governor lever 5′ instead of to the starting lever. The guide value is thus furnished here by means of the rotary magnet, similarly to the second embodiment shown in FIG. 3. The rpm adjuster 16′, which engages a drag lever 19′, counter to the force of a spring 7″, functions solely as a regulator for preventing excess rpm, that is, as a means for preventing engine racing.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. In an rpm governor for a fuel injection pump of an internal combustion engine comprising, a quantity adjustment means for determining the quantity of fuel injected, said quantity adjustment means being movable along a predetermined path between a first position at which a maximum quantity of fuel is injected and a second position at which a minimum quantity of fuel is injected, a shaft, a first and second governor lever means for positioning said quantity adjustment means, said first and second governor lever means being pivotable about said shaft, an rpm adjuster means for exerting a force on said first governor lever means proportioned to the rpm of the engine and thereby moving said first governor lever means in contact with said second governor lever means, restoring force means for exerting a force on one of said governor lever means by said rpm adjuster means, abutment means limiting the travel path of said second governor lever means in the direction of said restoring force, regulation intervention means, actuatable by air electronic control device which processes at least one engine parameter, for varying the setting of said rpm governor, said regulation intervention means comprising an electromagnet coupled to said abutment means, wherein said electromagnet is a rotary electromagnet having an output shaft and including a tang which is disposed eccentrically on said output shaft, and wherein said first governor lever means having one end which is engaged by said rpm adjuster means by said restoring means and wherein said second governor lever means having one end which is coupled to said quantity adjustment means and is engaged by said tang means.

* * * * *

UNITED STATES PATENT AND TRADEMARK OFFICE

CERTIFICATE OF CORRECTION

PATENT NO. : 4,461,255

DATED : July 24, 1984

INVENTOR(S) : Franz Eheim et al

It is certified that error appears in the above-identified patent and that said Letters Patent are hereby corrected as shown below:

Claim 1, column 4, line 47, "air" should be -- an --.

Signed and Sealed this

*Fifth* Day of *March 1985*

[SEAL]

*Attest:*

DONALD J. QUIGG

*Attesting Officer* *Acting Commissioner of Patents and Trademarks*